United States Patent [19]

Kim et al.

[11] Patent Number: 4,954,229

[45] Date of Patent: Sep. 4, 1990

[54] BIOELECTROCHEMICAL DESULFURIZATION OF PETROLEUM

[75] Inventors: Byung-Hong Kim; Tae-Sung Kim; Hae-Yeong Kim, all of Seoul, Rep. of Korea

[73] Assignee: Korea Advanced Institute of Science and Technology, Seoul, Rep. of Korea

[21] Appl. No.: 286,811

[22] Filed: Dec. 20, 1988

[30] Foreign Application Priority Data

Dec. 31, 1987 [KR] Rep. of Korea ..... 1987-15573

[51] Int. Cl.[5] ..... C25F 5/00

[52] U.S. Cl. ..... 204/130; 204/101; 204/131; 204/292; 204/294

[58] Field of Search ..... 204/130, 131, 149, 292, 204/294, 101

[56] References Cited

U.S. PATENT DOCUMENTS 2,641,564 3/1948 Zobell ..... 195/3
4,632,906 12/1986 Kopacz ..... 435/282

OTHER PUBLICATIONS

Kurita et al., "Decomposition of Some Organic Sulfur Compounds in Petroleum by Anaerobic Bacteria", J. Gen. Appl. Microbio., 17, 185–189, 1971.

Allen et al., "Electrochemical Regeneration of Redox Cofactors and Mediators—the Key to Bioelectrosynthesis", Trends in Biotechnology, vol. 3, No. 6, 1985.

Hongo et al., "Application of Electroenergizing Method of L-Glutamic Acid Fermentation", Agric. Biol.-Chem., 43(10), 2075–2081, 1979.

V. Eckart et al., "Microbial Desufurization of Petroleum and Heavy Petroleum Fractions 6. Comm.: Anaerobic Desulfurization of Romashikino Petroleum", Zentralbl. Mikrobiol. 141 (1986), 291–300.

F. J. Hartdegen et al., "Microbial Desulfurization of Petroleum", CEP May 1984, 63–67.

M. Kohler et al., "Microbial Desulfurization of Petroleum and Heavy Petroleum Fractors", Zbl. Mikrobiol. 139 (1984), 239–247.

Fermin Sagardia et al., "Degradation of Denzothiophene and Related Compounds by a Soil Pseudomonas in an Oil-Aqueous Environment", Applied Microbiologyo, Jun. 1975, pp. 722–725, vol. 29, No. 6.

K. A. Malik, "Microbial Removal of Organic Sulphur from Crude Oil and the Environment: Some New Prespectives", Process Biochemistry, Sep. 1978, pp. 10–12, 35.

D. J. Monticello et al., "Plasmid-Mediated Degradation of Dibenzothiophene by Pseudomonas Species", Applied and Environmental Microbiology, Apr. 1985, pp. 756–760, vol. 49, No. 4.

Alice L. Laborde et al., "Metabolism of Dibenzothiophene by a Beijerinchia Species", Applied and Environmental Microbiology, Dec. 1977, pp. 788–790, vol. 34, No. 6.

"Microbial Removal of Organic Sulphur from Crude Oil and the Environment: Some New Perspectives"; Malik, K. A., Process Biochemistry, 9/78.

"Microbiology in the Petroleum Industry", Davis, John B. and Updegraff, David M., Magnolia Petroleum Co., Field Research Lab.

Control of Carbon and Electron Flow in Clostridium Acetobutylicum Fermentations: Utilization of Carbon Monoxide to Inhibit Hydrogen Production and to Enhance Butanol Yields; Applied & Environmental Microbiology, Oct. 1984, pp. 764–770.

Electron Flow Shift in Clostridium Acetobutylicum Fermentation by Electrochemically Introduced Reducing Equivalent, Biotechnology Letters, vol. 10, No. 2, 123–128.

*Primary Examiner*—John F. Niebling
*Assistant Examiner*—Kathryn Gorgos
*Attorney, Agent, or Firm*—Armstrong, Nikaido, Marmelstein, Kubovcik & Murray

[57] ABSTRACT

A method for removing sulfur from a sulfur compound-containing fuel, as hydrogen sulfide, comprises subjecting the fuel to a bioelectrochemical process, in the presence of a bacterium having the ability to catalyze the reduction of a sulfur compound, to produce hydrogen sulfide.

10 Claims, 3 Drawing Sheets

BIOELECTROCHEMICAL DESULFURIZATION OF PETROLEUM

FIELD OF THE INVENTION

This invention relates to microbial desulfurization processes utilizing electrochemical energy as a source of reducing equivalent, decreasing organic sulfur constituents found in petroleum.

BACKGROUND OF THE INVENTION

Use of petroleum is expected to increase, despite diminishing world reserves of high quality crude oils. The sulfur oxides generated from the combustion of petroleum products may play a major role in the formation of acid deposition ("acid rain") which produce lasting detrimental effects on aquatic as well as terrestrial ecosystems. The demand for low sulfur petroleum has been intensified by increasingly stringent regulatory standards for reduced levels of sulfur oxide in atmospheric emissions. For compliance with the regulatory standards, fuels containing high sulfur content must be subjected to either pre- or post-combustion desulfurization. Processes for desulfurization of oil currently in use, both chemical and physical, still remain inadequate for coping with the problem. Desulfurization of heavy oil by hydrogenation or by other chemical procedures requires either special catalysts, extremely high temperatures, pressures or combinations thereof, making the process very expensive. Heavy metals in petroleum limit the use of hydrodesulfurization processes as they poison the catalysts used in such processes. Since both sulfur compounds and heavy metals are concentrated during refinery processing, sulfur removal from residual fuel oil is even more difficult. These disadvantages of conventional desulfurization processes and increased concern with the acid rain problem have stimulated interest in microbial sulfur transformations and the technology for microbial precombustion desulfurization.

The ubiquity of aromatic-thiophene derivatives in virtually all crude oils has led to the use of dibenzothiophene (DBT) as a model compound in investigation of crude oil desulfurization. Aerobic bacteria, such as Pseudomonas sp., Beijerinkia sp., *Bacillus sulfasportare,* have been used in attempts to remove organic sulfur compounds from petroleum and its products as water soluble forms (Malik, K. A. 1978, Process Biochem., 13 (9), 10). But, this process was found not to be economically feasible, and it was thought that air supply to the system for the oxidation of sulfur compounds by aerobic bacteria was dangerous.

The possibility of using anaerobic bacteria for the removal of sulfur compounds has been reported. Davis and Updegraff (1954. Bacteriol. Rev., 18, 215) attempted the microbial desulfurization of crude oil by certain sulfate reducing bacteria, but not successfully. Zobell in his patent (1953, U.S. Pat. No. 2,641,564) claimed that sulfate reducing bacteria with high hydrogenase activities can reduce organic sulfur in petroleum to hydrogen sulfide. The reactions were believed to be generally as follows:

$$\text{R-S-R}' + H_2 \rightarrow \text{RSH} + \text{R}'\text{H (or RH} + \text{R}'\text{SH)}$$

$$\text{R-S-R}' + 2H_2 \rightarrow \text{RH} + H_2S + \text{R}'\text{H}$$

Kurita et al (1971, J. Gen. Appl. Microbiol., 17, 185) showed that bacterial cultures which produce $H_2S$ from organic sulfur compounds in petroleum have been isolated under anaerobic condition. The isolates were also found to produce $H_2S$ from hydrogenated residue oil, crude oil, and asphaltene. Methyl viologen as an electron mediator was essential for the reaction. Kohler et al (1984, Zbl. Mikrobiol., 139, 239) reported that a selected Desulfovibrio strain utilizing molecular hydrogen can reduce nine sulfur compounds found in petroleum to $H_2S$, and that the degree of desulfurization achieved related to growth conditions and hydrogenase activity of the cultures. Eckart et al (1986, Zbl. Mikrobiol., 141, 291) used the mixed cultures from different sediments for anaerobic desulfurization of Romashkino petroleum. Main components of these mixed cultures were Desulfovibrio sp. and concomitant strains were found to be micrococci, bacilli, clostridia. The microbial desulfurization processes utilizing anaerobic bacteria described above also have a drawback. That is, hydrogen gas has to be supplied to the system for the reductive desulfurization of organic sulfur compounds in petroleum by sulfate reducing bacteria.

Therefore, utilization of electrochemical energy instead of hydrogen gas as a source of reducing equivalent would be very desirable for the convenient desulfurization of petroleum and its products.

BRIEF SUMMARY OF THE INVENTION

The invention comprises the utilization of electrochemical energy as a reducing agent instead of hydrogen gas in a microbial desulfurization process of fossil fuels such as petroleum and coal utilizing sulfate reducing bacteria as a catalyst.

LIST OF REFERENCE NUMBERS

Figure 2:
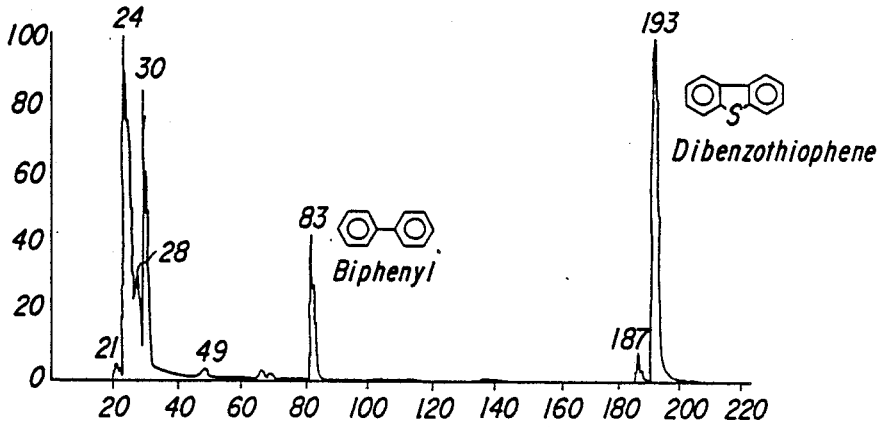

1. electrochemical cell
2. potentiostat
3. ammeter
4. recorder
5. immersion magnetic stirrer
6. agar bridge
7. shaking water bath
8. petroleum to be treated
9. aqueous phase containing bacterial cells and electron transfer mediator
10. gas purifying oven
11. ow pressure regulator
12. nitrogen gas
13. hydrogen sulfide absorber FIG. 2 is the gas chromatogram of dibenzothiophene treated in the system and extracted by n-butanol.

Figure 3A:
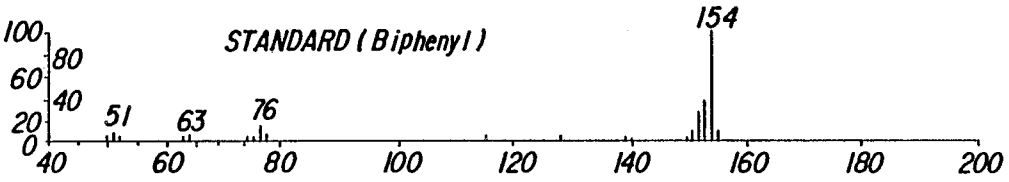
Figure 3B:
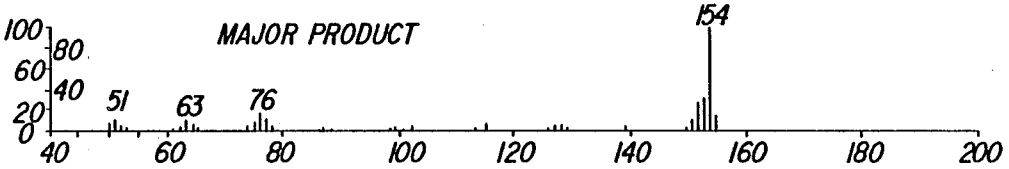

FIGS. 3*a* and 3*b* are the mass spectrum of the major product of dibenzothiophene treated in the system, separated by a gas chromatographic method.

Figure 4:
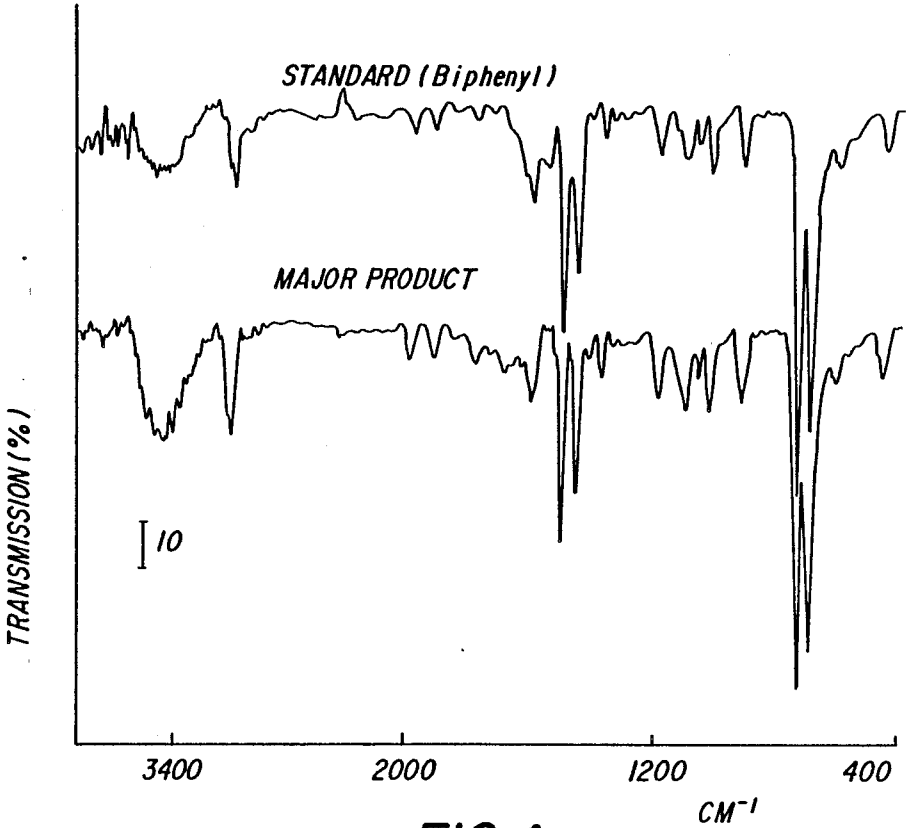

FIG. 4 is the infrared spectrum of the major product of dibenzothiophene treated in the system, separated by a preparative thin layer chromatogrphic method.

Figure 5:
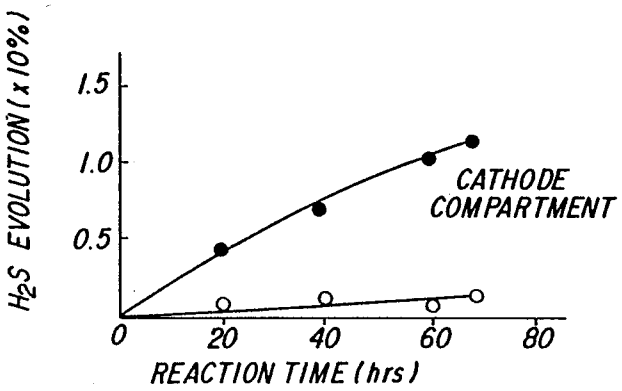

FIG. 5 is the kinetics of $H_2S$ evolution from crude oil by Desulfovibrio sp. M6 as treated in the system of this invention.

DETAILED DESCRIPTION OF THE INVENTION

In view of the problems or disadvantages normally encountered in chemical desulfurization, we have endeavored to find microbial species which catalyze the efficient conversion of organic sulfur to hydrogen sulfide.

Microorganisms were isolated from soil samples using Postgate medium E and cultivated in Postgate medium C. The compositions of Postgate medium C and E are as follows;

| Medium C (per liter) | |
|---|---|
| $KH_2PO_4$ | 0.5 g |
| $NH_4Cl$ | 1.0 g |
| $Na_2SO_4$ | 4.5 g |
| $CaCl_2.6H_2O$ | 0.06 g |
| $MgSO_4.7H_2O$ | 0.06 g |
| Sodium lactate | 6.0 g |
| Yeast extract | 1.0 g |
| $FeSO_4.7H_2O$ | 0.004 g |
| Sodium citrate.$2H_2O$ | 0.3 g |
| pH | 7.5 |
| **Medium E (per liter)** | |
| $KH_2PO_4$ | 0.5 g |
| $NH_4Cl$ | 1.0 g |
| $Na_2SO_4$ | 1.0 g |
| $CaCl_2.6H_2O$ | 1.0 g |
| $MgCl_2.7H_2O$ | 2.0 g |
| Sodium lactate | 3.5 g |
| Yeast extract | 1.0 g |
| Ascorbic acid | 0.1 g |
| Thioglycollic acid | 0.1 g |
| $FeSO_4.7H_2O$ | 0.5 g |
| pH | 7.6 |

Cultures were made in pressure tubes and serum vials with a 5% inoculum at 30° C. for mesophilic sulfate reducing bacteria. Reference cultures were obtained from the National Collection of Industrial and Marine Bacteria (NCIMB). These were *Desulfovibrio vulgaris* NCIMB 8303 and *Desulfovibrio desulfuricans* NCIMB 8310. Strictly anaerobic procedures were maintained in all experiments according to the method of Kim et al (1984, Appl. Environ. Microbiol., 48, 764).

Figure 1:
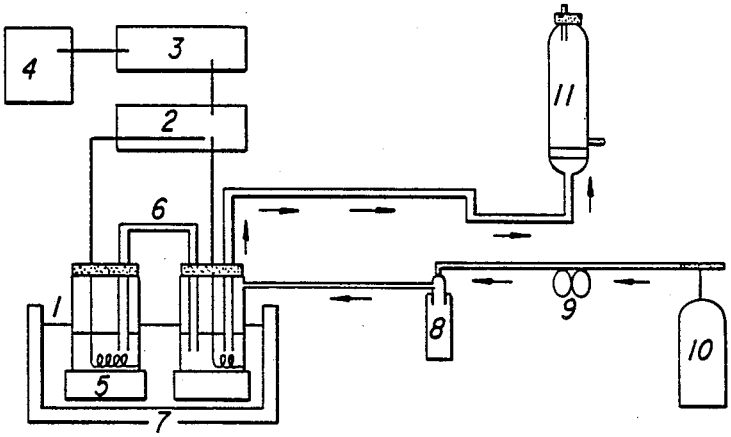
FIG. 1 is an electrochemical cell system for the study of microbial desulfurization by sulfate reducing bacteria.

A two compartment type of cell simular to that used by T. S. Kim and B. H. Kim (1988, Biotechol. Lett. 10 (2), 123) was used for the controlled supply of electrochemical energy (FIG. 1). The two-half cells were held together by a U shape agar bridge. Platinum wires or carbon material was used as the electrode in the electrochemical system. A reaction mixture, consisting of sulfate-free medium C with 2 mM methyl viologen, cell suspensions of sulfate reducing bacteria, and petroleum (or 0.1% dibenzothiophene) was added to the cathode compartment anaerobically. Methyl viologen was used for the efficient electron transfer between electrodes and bacterial cells as an electron mediator. The reaction mixture was stirred and purged with oxygen-free nitrogen. Working and counter electrodes were immersed in the aqueous phase of the anode and cathode compartments, respectively before electric potential was supplied using potentiostat connected to ammeter. The current was recorded continuously. Sulfate-free medium C was prepared with the following composition (per liter)

| | |
|---|---|
| $KH_2PO_4$ | 0.5 g |
| $NH_4Cl$ | 1.0 g |
| $CaCl_2.6H_2O$ | 0.06 g |
| Sodium lactate | 6.0 g |
| Yeast extract | 1.0 g |
| 0.2% resazurin | 1.0 g |
| pH | 7.4 |

The sulfur content of crude oil and its products were determined by the bomb method (ASTM Standard 1976. General bomb method, D 129-64). Hydrogen sulfide evolved during the reaction of microbial desulfurization was absorbed into a starch solution and titrated iodometrically by the Tutwiler method (1901, J. Am. Chem. Soc. 23, 173). The following examples will further illustrate the present invention.

EXAMPLE 1

Dibenzothiophene (DBT) was used as a model compound for the selection of bacterial strains to be used in petroleum desulfurization. Cultures grown for 2 days using postgate medium C were anaerobically harvested and suspended in anaerobic sulfate-free medium C. The cell suspensions were placed in a serum vial and 2 mM ethyl viologen and 0.1% (w/v) DBT were added before being incubated at 30° C. for 6 days on a rotary shaker. The headspace of the vial was filled with hydrogen gas. After the reaction, the reaction mixture was extracted by n-butanol for analyses by gas chromatographic and spectroscopic methods.

As shown in table 1, the amount of DBT recovered after the treatment according to the invention for 6 days ranges from 58% to 94%, whilst 96% of DBT was recovered from the control tubes. These results show that the reduction of DBT is not catalyzed by methyl viologen and hydrogen. Among the cultures tested, Desulfovibrio sp. M6 isolated from soil showed the highest ability to degrade DBT. Desulfovibrio sp. M6 was used in the further experiments. The the degradation products of DBT were identified by GC-mass spectroscopic and infrared spectroscopic methods.

FIG. 2 shows the gas chromatogram of dibenzothiophene treated in the system and extracted by n-butanol.

As shown in the figure, two new peaks at retention times of 83 and 187 seconds respectively appeared in addition to the dibenzothiophene peak at 193 seconds. The new peak at 83 second was analyzed by mass spectrometer. The mass spectrometric analysis showed that the DBT degradation compound separated at 83 seconds was biphenyl (FIG. 3). This result was further substantiated by infrared spectroscopic data obtained after separation on a preparative thin layer chromatogram (FIG. 4).

TABLE 1

Degradation of Dibenzothiophene (DBT) by Sulfate Reducing Bacteria.

| Reaction | Relative DBT concentration (%) | | | | | | | | |
|---|---|---|---|---|---|---|---|---|---|
| | Control | Control | NCIMB | | Isolates | | | | |
| Time (days) | 1 | 2 | 8303 | 8310 | M6 | M8 | S1 | SA | 5 |
| 0 | 100 | 100 | 100 | 100 | 100 | 100 | 100 | 100 | 100 |
| 4 | 97 | 98 | 95 | 92 | 87 | 98 | 90 | 90 | 90 |

TABLE 1-continued

Degradation of Dibenzothiophene (DBT) by Sulfate Reducing Bacteria.

| Reaction | Relative DBT concentration (%) | | | | | | | | |
|---|---|---|---|---|---|---|---|---|---|
| | Control | Control | NCIMB | | Isolates | | | | |
| Time (days) | 1 | 2 | 8303 | 8310 | M6 | M8 | S1 | SA | 5 |
| 6 | 96 | 96 | 85 | 81 | 58 | 94 | 83 | 79 | 88 |

Control 1: DBT only,
Control 2: DBT + 2 mM MV(methyl viologen)

Gases were not produced in the electrochemical cells where a potential of 2.5 volt was applied. We believe that water is not electrolyzed in our system. The reducing power for the reduction of the sulfur compounds is not from hydrogen gas but from the reduced methyl viologen. Methyl viologen reduced at the surface of the cathodic electrode moves into the cells where methyl viologen is oxidized by the enzyme system of the cell. The oxidation of methyl viologen is believed to be coupled to the reduction of the organic sulfur compounds.

EXAMPLE 2

Desulfovibrio sp. M6 was used to test its ability to reduce organic sulfur found in petroleum with electrochemically supplied reducing power. 35 (Thirty five) ml Kuwait crude oil containing about 3% sulfur was placed in the cathode compartment and the same volume of Desulfovibrio sp. M6 cell suspension in sulfate-free medium C with 2 mM methyl viologen was added. A platinum electrode with a surface area of 0.5 $cm^3$ was used. The cathode compartment was connected to the anode through a 10% KCl agar bridge and a potential of 2.5 volt was applied using a potentiostat for 6 days at 30° C. before the sulfur contents were analyzed by the bomb method. The $H_2S$ gas evolved during the reaction was also measured by the Tutwiler method. The electrochemical cells containing reaction solution were vigorously mixed under the conditions such that the electrode was completely immersed in the aqueous phase.

Table 2 shows the sulfur contents of crude oil after bioelectrochemical treatment using Desulfovibrio sp. M6.

As shown in this table, the sulfur content of crude oil was decreased by about 21% by the reaction according to this invention at 30° C. for 6 days. But little change was observed in the reaction mixture without electrochemical energy supply. $H_2S$ gas was evolved from the cathode compartment and the amount was increased as a function of reaction time (FIG. 5).

TABLE 2

Sulfur Contents of Crude Oil after Bioelectrochemical Treatment Using *Desulfovibrio* sp. M6.

| Treatment | Relative Sulfur Content (%) |
|---|---|
| Control (crude oil) | 100 |
| SRB and methyl viologen | 96 |
| Bioelectrochemical cathode | 79 |

EXAMPLE 3

A similar experiment to example 2 was conducted using a carbon electrode in the place of the platinum. The surface area of carbon electrode was 1.10 $cm^3$ and Desulfovibrio sp. M6 was also used as a catalyst in the desulfurization process.

Table 3 compares relative the sulfur contents of crude oil before and after bioelectrochemical treatment using a carbon electrode instead of a platinum electrode.

As shown in table, 3, the sulfur content was decreased by about 20.1% after 6 days of reaction and this result was similar to that obtained with a platinum electrode. In the case carrying out the reaction without electrochemical energy or methyl viologen, the sulfur content of crude oil was decreased to a much lesser degree. These results show that electrochemical energy and methyl viologen are essential for the efficient desulfurization of petroleum.

TABLE 3

Sulfur Contents of Crude Oil after Bioelectrochemical Treatment Using Carbon Electrode.

| Treatment | Relative Sulfur Content (%) |
|---|---|
| Control (crude oil) | 100 |
| SRB and methyl viologen | 96.5 |
| Electrochemical cathode without mehtyl viologen | 97.8 |
| Electrochemical cathode | 79.9 |

EXAMPLE 4

Similar experiments to examples 1 and 2 were performed using Diesel oil. The reducing equivalent supplied to the cathode compartment was electrochemical energy or hydrogen gas. Desulfovibrio sp. M6 and 2 mM methyl viologen, as an electron mediator, were also added and the reaction mixtures were vigorously mixed at 30° C.

Table 4 shows the sulfur contents of high sulfur Diesel oil after bioelectrochemical treatment using Desulfovibrio sp. M6 for 6 days.

As shown in this table, the sulfur contents of reaction mixtures treated with electrochemical electron or hydrogen gas were decreased by 23.2% and 39.1%, respectively. These results show that the bioelectrochemical desulfurization of high sulfur Diesel oil was more efficient than that of crude oil.

TABLE 4

Sulfur Contents of Diesel Oil after Bioelectrochemical Treatment Using *Desulfovibrio* sp. M6.

| Treatment | Relative Sulfur Content (%) |
|---|---|
| Control (Diesel oil) | 100 |
| Electrochemical cathode | 76.8 |
| Hydrogen gas | 60.9 |

The invention which is claimed is:

1. A method for removing sulfur from a sulfur containing fuel by reducing the sulfur compound to gaseous hydrogen sulfide, which comprises subjecting the fuel to a bioelectrochemical process, comprising contacting said sulfur containing fuel with an aqueous phase containing and electron mediator and bacterium having the ability to catalyze the reduction of a sulfur compound in a cathode compartment of an electrolytic cell, providing an anode counterelectrode in said cell, imposing an electric current on said cell sufficient to cause said sulfur to form hydrogen sulfide, and removing said hydrogen sulfide.

2. A method according to claim 1, which is conducted at 30° to 37° C.

3. A method according to claim 1, wherein the bacterium has the ability to catalyze the reduction of dibenzothiophene, to produce hydrogen sulfide.

4. A method according to claim 1, wherein anaerobic sludge from an oil tank is substituted for the bacterium.

5. A method according to claim 1, which is conducted in a partitioned electrochemical cell.

6. A method according to claim 5, wherein the cathode is of platinum or carbon.

7. A method according to claim 5, which is conducted using an aqueous phase containing methyl viologen electron transfer agent having an oxidation-reduction potential below −0.4 V.

8. A method as claimed in claim 7 wherein said electron transfer agent consists essentially of methyl viologen.

9. A method according to claim 8, wherein the bacterium is mesophilic Desulfovibrio sp.

10. A method as claimed in claim 1 including imposing a direct current across said fuel in contact with said aqueous phase.

* * * * *